US006220429B1

(12) United States Patent
Pasch

(10) Patent No.: US 6,220,429 B1
(45) Date of Patent: Apr. 24, 2001

(54) TAPE DISPENSING ASSEMBLY

(76) Inventor: Viola M. Pasch, 3619 W. Camino Del Rio, Glendale, AZ (US) 85310

( * ) Notice: Subject to any disclaimer, the term of this patent is extended or adjusted under 35 U.S.C. 154(b) by 0 days.

(21) Appl. No.: 08/869,013

(22) Filed: Jun. 4, 1997

(51) Int. Cl.[7] ..... B65D 85/28; A45C 11/34

(52) U.S. Cl. ..... 206/214; 206/225; 206/371; 206/411

(58) Field of Search ..... 206/214, 224, 206/371, 389, 225, 411, 493, 806; 242/570, 588, 600; 83/453; 225/106

(56) References Cited

U.S. PATENT DOCUMENTS

| | | | | |
|---|---|---|---|---|
| D. 181,245 | | 10/1957 | Boker . | |
| D. 251,095 | | 2/1979 | Nielsen . | |
| D. 373,794 | | 9/1996 | Ming . | |
| 2,305,592 | | 12/1942 | Anderson . | |
| 3,481,452 | * | 12/1969 | Pickios | 206/224 |
| 4,406,368 | * | 9/1983 | Hernes | 206/214 |
| 4,972,947 | * | 11/1990 | McCarthy | 206/214 |
| 5,050,733 | * | 9/1991 | Brennan | 206/493 |
| 5,385,230 | * | 1/1995 | Nygard et al. | 206/214 |
| 5,456,422 | * | 10/1995 | Longworth | 242/588 |
| 5,641,378 | * | 6/1997 | Luhman et al. | 206/411 |

* cited by examiner

*Primary Examiner*—Luan K. Bui
(74) *Attorney, Agent, or Firm*—Parsons & Goltry; Robert A. Parsons; Michael W. Goltry

(57) ABSTRACT

A tape dispensing assembly, comprising a base, a drum extending outwardly from the base and terminating with an outer end, a first pin spaced from the drum and extending outwardly therefrom and terminating with an outer end, a second pin spaced from the drum and extending outwardly therefrom and terminating with an outer end, the second pin further being located proximate the first pin with a space formed therebetween the first pin and the second pin, and an extended strip of adhesive tape wound upon a core to form a roll and having an adhesive surface, the roll mountable upon the drum for rotation, wherein a user may grasp a free end of the extended strip, pull the extended strip from the roll, pass the extended strip proximate the first and second pins in lateral traverse with the adhesive surface of the extended strip facing the first and second pins, and sever the extended strip proximate the space intermediate the first pin and the second pin to form a strip segment and a severed free end of the extended strip, whereby upon severing, the strip segment will adhesively adhere to the second pin and the severed free end of the extended strip will adhere to the first pin thereby preventing the strip segment and the severed free end of the extended strip from becoming entangled and preventing the severed free end of the extended strip from adhering back upon the roll.

10 Claims, 1 Drawing Sheet

TAPE DISPENSING ASSEMBLY

BACKGROUND OF THE INVENTION

1. Field of the Invention

This invention relates generally to the field of dispensers.

More particularly, this invention relates to a tape dispensing assembly for dispensing adhesive tape from a roll.

2. Prior Art

The prior art is replete with apparatus for dispensing adhesive tape from a roll. Adhesive tape normally includes a thin flexible backing of fabric, paper, plastic or other non-fibrous material including a surface having a pressure sensitive adhesive coating. For ease of use, the foregoing variety of adhesive tape is normally wound upon a core to form a roll.

Adhesive tape is well known and highly useful for a multitude of selected operations. However, along with the advent of adhesive tape arose difficulties with easily and efficiently dispensing and severing the tape to form segments of tape of preselected lengths suitable for intended use. Although the prior art provides a variety of apparatus operative for aiding a user in dispensing and severing tape, difficulties still exist with large taping operations such as closing boxes and other similarly large taping operations.

It would be highly advantageous, therefore, to remedy the foregoing and other deficiencies inherent in the prior art.

Accordingly, it is an object of the present invention to provide a new and improved tape dispensing assembly.

Another object of the present invention is to provide a tape dispensing assembly that is easy to use.

And another object of the present invention is to provide a tape dispensing assembly that is easy to make.

Still another object of the present invention is to provide a tape dispensing assembly that is inexpensive.

Yet another object of the instant invention is to provide a tape dispensing assembly operative for allowing a user to easily dispense and sever adhesive tape for large taping operations such as closing boxes and other similarly large taping operations.

Yet still another object of the instant invention is the provision of enhancing the speed and efficiency of using adhesive tape in large taping operations.

And a further object of the invention is to provide a tape dispensing assembly that is convenient to use.

SUMMARY OF THE INVENTION

Briefly, to achieve the desired objects of the instant invention in accordance with a preferred embodiment thereof, provided is a tape dispensing assembly including a base having a drum extending outwardly from the base and terminating with an outer end. Further included is a first pin spaced from the drum and extending outwardly therefrom and terminating with an outer end, and a second pin spaced from the drum and extending outwardly therefrom and terminating with an outer end, the second pin further being located proximate the first pin with a space formed therebetween the first pin and the second pin. An extended strip of adhesive tape having an adhesive surface is also provided and is wound upon a core to form a roll. The roll is mountable upon the drum for rotation. In operation, a user may grasp a free end of the extended strip, pull the extended strip from the roll, pass the extended strip proximate the first and second pins in lateral traverse with the adhesive surface of the extended strip facing the first and second pins, and sever the extended strip proximate the space intermediate the first pin and the second pin to form a strip segment and a severed free end of the extended strip, whereby upon severing, the strip segment will adhesively adhere to the second pin and the severed free end of the extended strip will adhere to the first pin thereby preventing the strip segment and the severed free end of the extended strip from becoming entangled and preventing the severed free end of the extended strip from adhering back upon the roll.

BRIEF DESCRIPTION OF THE DRAWINGS

The foregoing and further and more specific objects and advantages of the instant invention will become readily apparent to those skilled in the art from the following detailed description of preferred embodiments thereof taken in conjunction with the drawings in which.

DETAILED DESCRIPTION OF THE PREFERRED EMBODIMENT

Figures 1, 2, 3, 4, 5:
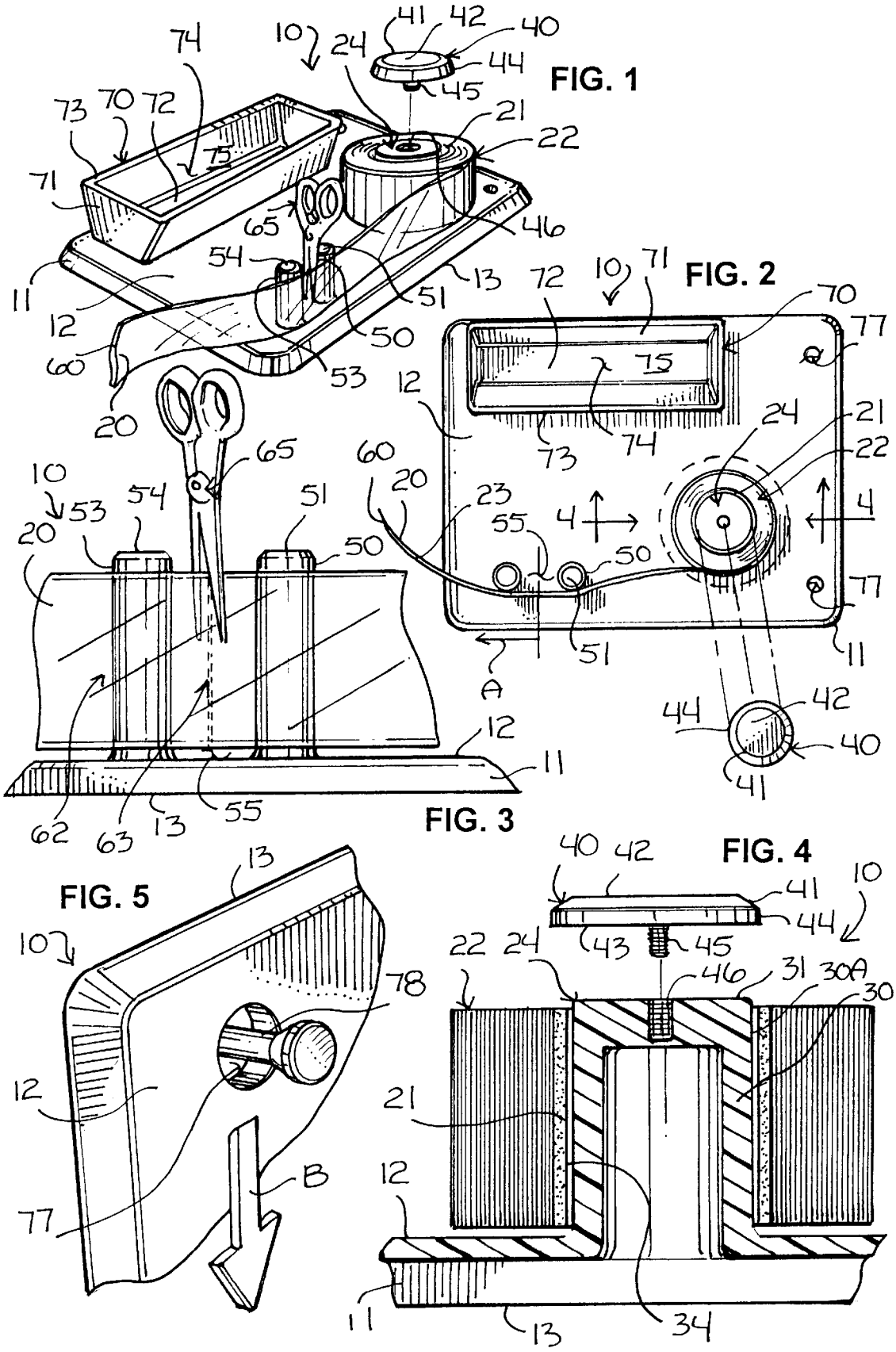
FIG. 1 illustrates a perspective view of a tape dispensing assembly showing an extended strip of adhesive tape wound upon a core to form a roll, the roll mounted for rotation to a drum carried by a base with a retention member shown spaced from the drum and operative for securing the roll to the drum, the extended strip shown drawn across a pair of pins extending outwardly from the base with a cutting instrument shown severing the extended strip at a space located intermediate the pins, in accordance with a preferred embodiment of the present invention.
FIG. 2 is a top plan view of the tape dispensing assembly of FIG. 1 and further showing the retention member spaced from the drum.
FIG. 3 is an enlarged fragmented side elevational view of the pair of pins of the tape dispensing assembly of FIG. 1 further showing the cutting instrument of FIG. 1 severing the extended strip of tape at the space intermediate the pair of pins.
FIG. 4 is a vertical sectional view of the drum and the roll of adhesive tape taken along line 4—4 of FIG. 2, further showing the retention member spaced from the drum.
FIG. 5 is a fragmented perspective view of the base of FIG. 1 further showing an aperture extending therethrough for receiving a fastener for fastening the base to a selected support surface.

Turning now to the drawings, in which like reference characters indicate corresponding elements throughout the several views, attention is first directed to FIG. 1 illustrating a perspective view of a tape dispensing assembly being generally designated by the reference character 10. Tape dispensing assembly 10 includes a base 11 having a substantially planar support surface 12 and a lower end 13 for bearing against a supporting surface such as, for example, a table, a countertop, the ground or other selected supporting surface. With continuing reference to FIG. 1 and additional reference to FIG. 2 illustrating a top plan view of the tape dispensing assembly of FIG. 1, tape dispensing assembly 10 further includes an extended strip 20 of adhesive tape wound upon a core 21 to form a roll 22, extended strip 20 having an adhesive surface 23 (shown only in FIG. 2) typical with conventional and well known varieties of adhesive tape. Roll 22 is mountable for rotation upon a drum 24 carried by and extending outwardly from base 11.

With momentary reference to FIG. 4 illustrating a vertical sectional view of drum 24 and roll 22 taken along line 4—4 of FIG. 2, drum 24 includes a continuous sidewall 30 having an outer surface 30A defining an outer diameter, continuous sidewall 30 extending outwardly from supporting surface 12 of base 11 and terminating with a free end 31. In FIG. 4, drum 24 is shown integrally formed with base 11. However, this is not an essential feature of the present invention and drum 24 may otherwise be provided as a separate accessory that may be fixed or otherwise mounted to base by virtue of a conventional fastening mechanism such as a suitable adhesive, one or more screws or other selected fastening mechanism. Furthermore, outer surface 30A is preferably generally cylindrical, although this is not an essential feature of the present invention.

As herein previously intimated, roll 22 is mountable for rotation upon drum 24 in a direction from free end 31 thereof. In this regard, and in the specific example shown in FIG. 4, core 21 includes an inner surface 34 defining an inner diameter somewhat greater than the outer diameter of drum 24 as defined by outer surface 30A such that when received thereon, roll 22 will easily rotate about drum 24 in the clockwise and counterclockwise directions. However, and consistent with the teachings of the present invention, drum 24 may alternatively be rotatably mounted to base 11 if desired. In this regard, the diameter of drum 24 as defined by outer surface 30A may be constructed of a size such that when roll 22 is mounted upon drum 24, the inner surface 34 of core 21 will compress and secure against the outer surface 30A of drum 24. As a consequence, rather than being rotatable about drum 24, roll 22 may rotate along with drum 24. Consistent with conventional practice, inner surface 34 of core 21 is preferably generally cylindrical, although this is not an essential feature of the present invention.

Nevertheless, regarding a preferred embodiment of the present invention and with continuing reference to FIGS. 1, 2 and 4, tape dispensing assembly 10 may further include a retention member 40 having a generally circular body 41 with an upper surface 42, a lower surface 43 (not shown in FIGS. 1 and 2) and a continuous outer edge 44 defining a diameter somewhat greater than the outer diameter of drum 24 and the inner diameter of roll 22 as defined by core 21. Retention member 40 is preferably detachably engagable to drum 24 after roll 22 has been mounted thereon for securing roll 22 to drum 24 and for inhibiting roll 22 from falling off drum 24. In this regard, and with particular attention to FIG. 1 and FIG. 4, retention member further includes an engagement element 45 extending downwardly from the lower surface 43 thereof. Engagement element 45 is detachably engagable to a complemental engagement element 46 formed into and through free end 31 of drum 24. Although a variety of suitable and conventional engagement mechanisms may be used for detachably engaging retention member 40 to free end 31 of drum 24, engagement element 45 is preferably a threaded element and complemental engagement element a threaded bore or recess. In this respect, after roll 22 is mounted upon drum 24, the threaded element of retention member 40 may be threadably and detachably secured to the threaded bore or recess of drum 24 upon rotation of retention member 40 in a predetermined and selected direction.

With continuing reference to FIG. 1 and FIG. 2 and additional reference to FIG. 3, tape dispensing apparatus further includes a first pin 50 spaced from drum 24 and extending outwardly from supporting surface 12 of base 11 and terminating with an outer end 51. First pin 50 is preferably generally cylindrical, although this is not essential. Further provided is a second pin 53 spaced from drum 24 and extending outwardly from supporting surface 12 of base 11 and terminating with an outer end 54. Second pin 53 is preferably located proximate first pin 51 with a space 55 (shown only in FIGS. 2–3) formed therebetween first pin 51 and second pin 53. Like first pin 51, second pin 53 is also preferably generally cylindrical, although this is not essential.

In operation, after roll 22 of adhesive tape has been mounted to drum 24 consistent with the foregoing discussion, a user may grasp a free end 60 (FIG. 1 and FIG. 2) of extended strip 20, pull extended strip 20 from roll 22 and pass extended strip 20 by and proximate to first pin 50 and second pin 53 in lateral traverse relative first pin 50 and second pin 53 in the direction indicated by the arrowed line A in FIG. 2 with the adhesive surface 23 of extended strip 20 facing first pin 51 and second pin 53. As shown in FIG. 3, with extended strip 20 laterally traversing first pin 51, second pin 53 and space 55 and pulled beyond second pin 53 a predetermined distance, a user may then sever extended strip 20 at a location proximate space 55 intermediate first pin 51 and second pin 53 to form a strip segment 62 offset from second pin 53 and a severed free end 63 of extended strip 20 offset first pin 51. Upon severing extended strip 20 in the foregoing manner with scissors 65 as shown in FIG. 1 and FIG. 3 or other suitable mechanical cutting instrument or means, adhesive surface 23 of strip segment 62 will adhesively adhere to second pin 53 and adhesive surface 23 proximate severed free end 63 of extended strip 20 will adhesively adhere to first pin 51 thereby preventing strip segment 62 and severed free 63 end of extended strip 20 from becoming entangled and preventing severed free end 63 of extended strip 20 from adhering back upon roll 22. A user may then remove strip segment 62 from second pin 53 and use strip segment 62 for a selected and desired operation such as closing a box or other selected operation. The foregoing process may then be repeated as necessary.

It will be readily understood by those having regard toward the relevant art that strip segment 62 may be formed having any selected and desired length depending upon the needs of the user. Furthermore, to further the advantageous features of the present invention, first pin 51 and second pin 53 are preferably disposed in series so as to define a plane generally perpendicular to the plane within which extended strip 20 may be pulled away from roll 22. In this manner of orientation, adhesive surface 23 of strip segment 62 and the adhesive surface 23 of extended strip 20 proximate severed free end 63 may easily and readily face both first and second pins 51 and 53 and readily adhere thereto either prior to severing extended strip at the location proximate space 55 or upon severing extended strip at the location proximate space 55.

It will be readily understood that when roll 22 of adhesive tape is used up, or a user merely wishes to replace roll 22 with a different roll of adhesive tape, a user may detach retention member 40 from outer end 31 of drum 24 upon rotation of retention member 40 in a preselected direction, remove roll 22, replace it with another roll of adhesive material and then reattach retention member 40 in the manner previously described.

Various changes and modifications to the embodiment herein chosen for purposes of illustration will readily occur to the skilled artisan. For example, as shown in FIG. 1 and FIG. 2, tape dispensing assembly may further include a container 70 for holding items such as scissors, rolls of adhesive tape, pencils, pens, markers or other selected items. Container 70 includes a continuous sidewall 71 having a closed lower end 72 mounted to supporting surface 12 of base 11 and extends outwardly therefrom and terminates with an upper edge 73 bounding an opening 74 into a chamber 75 bound by closed lower end 72 and continuous sidewall 71. Closed lower end 72 of container 70 may be mounted to supporting surface 12 of base 11 by virtue of integral molding or perhaps by virtue of a conventional fastening mechanism such as a selected adhesive, screws or other conventional fastening mechanism in spaced-apart relation from drum 24, first pin 51 and second pin 53 so as not to interfere with the advantageous operation of tape dispensing assembly 10. In this manner, container 70 may provided a convenient storage receptacle for advantageously retain selected items. A cover, not shown, can also be included to retain items within container 70. Furthermore, tape dispensing assembly, including base 11, drum 24 first pin 51, second pin and container 70 may be constructed of any suitable material such as molded plastic, a selected type of metal, wood or other substance having similar structural and functional characteristics.

Additionally, as shown in FIG. 2 and FIG. 5, base 11 may be provided with apertures 77 sized for receiving a conventional fastener 78, such as a nail or a screw, for mounting base 11 to a supporting surface. Additional fasteners may be added as necessary to fasten base 11 securely to a surface. It will also be understood that an adhesive can also be used to secure the base. The supporting surface may be the top surface of a counter or a table, or perhaps a substantially vertical surface such as a wall or the like in which tape dispensing apparatus 10 may extend downwardly along the substantially vertical surface from the location of apertures 77 in the direction indicated by the arrow B in FIG. 5. To the extent that the foregoing modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

1. A tape dispensing assembly, comprising:

a base;

a drum extending outwardly from said base and terminating with an outer end;

a first pin spaced from said drum and extending outwardly therefrom and terminating with an outer end;

a second pin spaced from said drum and extending outwardly therefrom and terminating with an outer end, said second pin further being located proximate said first pin with a space formed therebetween said first pin and said second pin; and an extended strip of adhesive tape wound upon a core to form a roll and having an adhesive surface, said roll mountable upon said drum for rotation;

wherein a user grasp a free end of said extended strip, pull said extended strip from said roll, pass said extended strip proximate said first and second pins in lateral traverse with the adhesive surface of said extended strip facing said first and second pins, and sever said extended strip proximate said space intermediate said first pin and said second pin to form a strip segment and a severed free end of said extended strip, whereby upon severing, said strip segment will adhesively adhere to said second pin and said severed free end of said extended strip will adhere to said first pin thereby preventing said strip segment and said severed free end of said extended strip from becoming entangled and preventing said severed free end of said extended strip from adhering back upon said roll.

2. The tape dispensing assembly of claim 1, wherein said drum is generally cylindrical.

3. The tape dispensing assembly of claim 1, wherein said first pin is generally cylindrical.

4. The tape dispensing assembly of claim 1, wherein said second pin is generally cylindrical.

5. The tape dispensing assembly of claim 1, further including a container fixed to said base and spaced from said drum, said first pin and said second pin, said container including a continuous sidewall having a closed end fixed to said base and an open upper end, said container operative for holding one or more selected items.

6. The tape dispensing assembly of claim 1, further including a retention member detachably engagable to the free end of said drum, said retention member operative for securing said roll to said drum.

7. The tape dispensing assembly of claim 6, said drum further including an outer surface defining an outer diameter;

said core further including an inner surface defining a diameter somewhat greater than the diameter of said drum;

said retention member including a body having an outer diameter greater than the outer diameter of said drum and the inner diameter of said core of said roll; and means for detachably engaging said body of said retention member to said free end of said drum.

8. The tape dispensing assembly of claim 7, wherein said means for detachably engaging said body of said retention member to said free end of said drum includes an engagement element carried by said body of said retention member and a complemental engagement element carried by said free end of said drum, said engagement element being detachably engagable to said complemental engagement element.

9. The tape dispensing assembly of claim 8, wherein said engagement element includes a threaded element.

10. The tape dispensing assembly of claim 9, wherein said complemental engagement element includes a threaded recess.

* * * * *